US009353736B1

(12) United States Patent
Scalzi

(10) Patent No.: US 9,353,736 B1
(45) Date of Patent: May 31, 2016

(54) MODULAR RADIAL COMPRESSOR

(76) Inventor: Saverio Scalzi, Hollywood, FL (US)

( * ) Notice: Subject to any disclaimer, the term of this patent is extended or adjusted under 35 U.S.C. 154(b) by 379 days.

(21) Appl. No.: 12/803,988

(22) Filed: Jul. 12, 2010

Related U.S. Application Data

(63) Continuation-in-part of application No. 11/284,335, filed on Nov. 21, 2005, now abandoned.

(51) Int. Cl.
*F04B 9/04* (2006.01)
*F04B 27/053* (2006.01)
*F04B 39/14* (2006.01)

(52) U.S. Cl.
CPC ..... *F04B 27/053* (2013.01); *F04B 39/14* (2013.01)

(58) Field of Classification Search
CPC ..... F04B 1/04; F04B 1/0404; F04B 1/053; F04B 27/04; F04B 27/0404; F04B 27/053; F04B 27/0531; F04B 27/0536; F04B 9/02; F04B 9/042; F04B 35/01; F04B 39/14
USPC ..... 417/214, 218, 221, 267, 273, 470, 471; 74/54, 122, 124, 572.2, 567–569, 22 A, 74/55; 184/6.5, 24, 6.16, 33; 91/129
See application file for complete search history.

(56) References Cited

U.S. PATENT DOCUMENTS

| | | | | |
|---|---|---|---|---|
| 895,755 | A | 8/1908 | Hedstrom | |
| 962,203 | A * | 6/1910 | Emerson et al. | 184/24 |
| 1,063,592 | A | 6/1913 | Ragan | |
| 1,882,928 | A | 10/1932 | Rockwll | |
| 1,904,799 | A * | 4/1933 | Palmer | F02M 21/00 137/512.3 |
| 2,056,901 | A * | 10/1936 | Kylén | 184/6.5 |
| 2,319,718 | A * | 5/1943 | Brooks | F04B 27/0414 417/233 |
| 2,631,538 | A | 3/1953 | Johnson | |
| 3,103,824 | A * | 9/1963 | Grumann | G07F 17/305 74/116 |
| 3,545,896 | A | 12/1970 | Zahradnik | |
| 3,697,764 | A | 10/1972 | Stanziola et al. | |
| 3,951,046 | A * | 4/1976 | Lochmann et al. | 92/113 |
| 4,105,371 | A * | 8/1978 | Savage et al. | 417/238 |
| 4,132,512 | A | 1/1979 | Roberts | |
| 4,313,714 | A | 2/1982 | Kubeczka | |
| 4,966,102 | A | 10/1990 | Mulakken | |
| 5,711,206 | A | 1/1998 | Goettel | |
| 5,720,596 | A | 2/1998 | Pepperman | |
| 5,966,935 | A | 10/1999 | Liu | |
| 6,089,141 | A | 7/2000 | Okesaku | |
| 6,158,953 | A | 12/2000 | Lamont | |
| 6,412,454 | B1 * | 7/2002 | Green | 123/54.1 |
| 8,435,012 | B2 * | 5/2013 | Clinciu | F04B 35/01 152/418 |
| 2001/0141855 | | 7/2004 | Wang | |
| 2004/0213679 | A1 * | 10/2004 | Cornwell | 417/307 |
| 2009/0155107 | A1 * | 6/2009 | Ruiz Martinez | B60K 6/12 417/516 |

* cited by examiner

*Primary Examiner* — Charles Freay
(74) *Attorney, Agent, or Firm* — Oltman, Flynn & Kubler

(57) ABSTRACT

A modular radial compressor for compressing fluids includes a compression vessel having a collapsible vessel internal space having expanded and a compressed sizes, the compression vessel having an intake structure for passing fluid into the vessel internal space from a fluid source and an output structure for passing fluid out of the vessel internal space; a rotatable arm structure having an arms structure rotational axis and at least one radial arm protrusion positioned to periodically about one or multiple compression vessels and compress the vessel internal spaces; a rotational drive mechanism drivably connected to the rotatable arm structure for rotatably driving the arm structure and the arm protrusion about the arm structure rotational axis; and a compression vessel expansion mechanism for expanding the vessel internal space to its expanded size subsequent to each vessel internal space compression.

21 Claims, 8 Drawing Sheets

MODULAR RADIAL COMPRESSOR

FILING HISTORY

This application is a continuation-in-part of application Ser. No. 11/284,335 filed on Nov. 21, 2005 now abandoned.

BACKGROUND OF THE INVENTION

1. Field of the Invention

The present invention relates generally to the field of compression and storage of fluids and particularly to compression of gaseous matter. More specifically the present invention relates to an apparatus in the form of a modular radial compressor for compressing any gas or gaseous matter hereinafter referred to as a fluid, including at least one cylinder and piston assembly including a cylinder having a cylinder head and a tubular cylinder side wall and a piston structure slidably retained within the tubular cylinder side wall, the cylinder head having an intake port fitted with an intake valve for passing fluid into the cylinder from a fluid source and an output port fitted with an output valve for passing fluid out of the cylinder such as to a fluid reservoir, valve operating means, a rotatable arm structure in the form of an arm wheel having an arm structure axle and radial arm protrusions in the form of arms positioned to periodically abut and displace the piston structure inwardly toward the cylinder head, and rotational drive means drivably connected to the rotatable arm wheel for rotatably driving the arm wheel and the arms about the arm wheel rotational axis, and a piston structure return means for displacing the piston structure outwardly away from the cylinder head subsequent to each piston structure inward displacement. The compressor manufacturer decides the number of arms per arm wheel, and the number of cylinder and piston assemblies to be included is determined by the purchaser as a result of the compressor modularity. The valve operating means opens the output valve and an arm abuts and displaces the piston structure toward the cylinder head, driving fluid within the cylinder out of the cylinder through the output port, and then the valve operating means closes the output valve and opens the intake valve and the piston structure return means displaces the piston structure outwardly, away from the cylinder head and the intake port, thereby drawing fluid through the intake port into the cylinder from the fluid source, in a periodically repeating cycle. The cylinder and piston assembly and arm wheel preferably are both fastened to an apparatus framework to position them in operational relation with each other. The apparatus framework preferably includes an apparatus housing preferably having a polygonal or round shape and enclosing at least the arm wheel. The intake port optionally is covered by an air filter retained within an air filter housing.

Modularity is a key inventive feature of the present invention. Either one or several single cylinder and piston assemblies can be removably fastened to the framework, such as to the housing, with any suitable removable fastening means such as mounting bolts passing through the housing into or through the cylinder and piston assembly. Where mounting bolts are used, bolt holes are provided in the housing for passing the mounting bolts for each cylinder and piston assembly. These bolt holes preferably are pre-cut during housing manufacture, but alternatively may be cut any time thereafter. As a result, any desired number of cylinder and piston assemblies up to the maximum number the particular housing can accommodate can be mounted. Thus the number of cylinder and piston assemblies needed for a specific use or application can be selected and provided on an individual modular radial compressor of the present invention.

The number of arms provided on the arm structure determines the number of compression cycles the cylinder and piston assembly performs for each revolution of the arm structure, and is selected to meet the requirements of the given application. A flywheel preferably is provided adjacent the arm wheel and mounted to the arm wheel axle to provide smooth arm rotation. The piston structure preferably includes a piston connected to a piston rod. The rotational drive means preferably includes an electric drive motor connected to the arm structure with a belt and pulleys or other drive connection. Thus each modular radial compressor typically has one flywheel and one pulley, although additional ones may be added. Between the flywheel and the arm wheel, a clutch optionally connects the arms wheel to the pulley shaft after a few seconds, thereby avoiding the stress for the electric motor and avoid what is known as demand factor to the electric motor, in a 3-phase system.

The number of arms on the arm structure preferably can be altered such that the volume of fluid compressed per arm structure revolution can be altered to accommodate any of a wide variety of applications. Another variation of the present modular radial compressor includes a plurality of cylinder and piston assemblies positioned and secured to the apparatus framework to extend radially and equidistantly from the arm structure to be operated by the arms in sequence. Yet another variation of the compression apparatus includes multiple arm structure and cylinder units. The arm structures preferably are arm wheels mounted on a common arm structure axle and thus driven by a common motor drive means.

2. Description of the Prior Art

There have long been compressors for compressing gaseous matter for storage or immediate use. These prior compressors typically have included a cylinder and piston combination driven by a motor or engine. A problem with these prior compressors has been that they can produce only one compression per motor or engine revolution, limiting compression to a specific rate which may or may not be suited for a given application. If a larger compression rate is needed, a different and larger compressor must be located.

Stanziola, et al., U.S. Pat. No. 3,697,764, issued on Oct. 10, 1972, discloses a method and apparatus for generating electricity including a series of cylinder and piston assemblies arranged radially around and in operational relation with a cam wheel. A shortcoming of Stanziola, et al. is that there is no provision for altering the number of cylinder and piston assemblies positioned around the cam wheel to meet specific requirements.

Other references cited in the parent application are incorporated by reference into this section, including but not limited to Palmer, U.S. Pat. No. 1,904,799; Cornwell, U.S. Patent Publication Number 2004/0213679A1; Goettel U.S. Pat. No. 5,711,206; Hedstrom U.S. Pat. No. 895,755; Wang U.S. Patent Publication Number 2004/0141855 A1; Tyler U.S. Pat. No. 2,631,538; Lochmann, et al., U.S. Pat. No. 3,951,046; Roberts, U.S. Pat. No. 4,132,512; Pepperman, U.S. Pat. No. 5,720,596; and Kubeczka, U.S. Pat. No. 4,313,714.

It is thus an object of the present invention to provide a modular radial compressor which can compress a fluid at any of several different rates selectable for a given job or application, the apparatus including an arm structure or a multiple arms structure rotatably driven by drive means and at least one cylinder and piston assembly driven through compression cycles by contact with at least one arm protrusion on the rotating structure.

It is another object of the present invention to provide such a modular radial compressor for which a specific desired rate of fluid compression can be selected by: selecting the number of cylinder and piston assembly compressions per revolution of motor drive means by altering the number of arm protrusions on the rotating arm structure, or by selecting the number of cylinder and piston assemblies operated with each revolution of the motor drive means, or by selecting the number of arm structure and corresponding cylinder and piston assemblies, or by altering all three variables as needed.

It is yet another object of the present invention to provide such a modular radial compressor which is modular in that cylinder and piston assemblies are removable and re-attachable to the compressor housing so that a desired number of cylinder and piston assemblies can be selected and attached for each particular use or application, making the compressor highly versatile.

It is a further object of the present invention to provide such a modular radial compressor which is inexpensive to manufacture, in part because the compressor is made in only one standard size for all applications, and which also saves money because a single modular radial compressor can be purchased, rather than several compressors have different fixed numbers of cylinder and piston assemblies for different jobs. More than the standard number of cylinder and piston assemblies for a given compressor can be installed by enlarging the size of the compressor housing or adding other cylinder and piston assembly mounting means.

It is still another object of the present invention to provide such a modular radial compressor with which such selections can be made automatically by computer program operated electric switches.

It is finally an object of the present invention to provide such a modular radial compressor which is reliable, durable, operates on less electricity, and is economical to manufacture.

SUMMARY OF THE INVENTION

The present invention accomplishes the above-stated objectives, as well as others, as may be determined by a fair reading and interpretation of the entire specification.

A modular radial compressor is provided for compressing fluids, including a compression vessel having a collapsible vessel internal space having an expanded size and a compressed size, the compression vessel having intake structure for passing fluid into the vessel internal space from a fluid source and output structure for passing fluid out of the vessel internal space; a rotatable arm structure having an arm structure rotational axis and at least one radial arm protrusion positioned to periodically abut the compression vessel and compress the vessel internal space; a rotational drive mechanism drivably connected to the rotatable arm structure for rotatably driving the arm structure and the arm protrusion about the arm structure rotational axis; and a compression vessel expansion mechanism for expanding the vessel internal space to its expanded size subsequent to each compression of the vessel internal space; so that compression of the vessel internal space drives fluid within the vessel internal space out of the vessel through the output structure, and then the compression vessel return mechanism expands the vessel internal space, thereby drawing fluid through the intake structure into the vessel internal space from the fluid source, in a repeating cycle.

The compression vessel preferably includes a cylinder and piston assembly having a cylinder interior and the vessel internal space comprise the cylinder interior.

A modular radial compressor for compressing fluids is further provided, including at least one cylinder and piston assembly including a cylinder having a cylinder head and a tubular cylinder side wall and a piston structure slidably retained within the cylinder, the cylinder having an intake port fitted with an intake valve for passing fluid into the cylinder from a fluid source and an output port fitted with an output valve for passing fluid out of the cylinder; a valve operating mechanism in operational relation with the intake valve and the output valve; a rotatable arm structure having an arm structure rotational axis and at least one radial arm protrusion positioned to periodically abut and displace the piston structure inwardly toward the cylinder head; a rotational drive mechanism drivably connected to the rotatable arm structure for rotatably driving the arm structure and the arm protrusion about the arm structure rotational axis; and a piston structure return mechanism for displacing the piston structure outwardly and away from the cylinder head subsequent to each piston structure inward displacement; so that the valve operating mechanism opens the output valve and the arm protrusion abuts and displaces the piston structure toward the cylinder head, driving fluid within the cylinder out of the cylinder through the output port, and then the valve operating mechanism closes the output valve and opens the intake valve and the piston structure return mechanism displaces the piston structure outwardly, away from the cylinder head and the intake port, thereby drawing fluid through the intake port into the cylinder from the fluid source, in a repeating cycle, as in any conventional cylinder and piston operation.

The cylinder and piston assembly and the arm structure preferably are both fastened to an apparatus framework to position the cylinder and piston assembly and the arm structure in operational relation with each other. The apparatus framework preferably includes an apparatus housing. The intake port preferably is covered by an air filter structure. The at least one arm protrusion preferably is at least one arm and the arm structure preferably includes an arm wheel having an arm wheel circumferential surface to which the at least one arm is mounted. The modular radial compressor preferably additionally includes a flywheel mounted to rotate in unison with the arm structure to provide smooth arm structure rotation.

The piston structure preferably includes a piston connected to a piston rod extending out of the cylinder opposite the cylinder head having a piston rod abutment end. The piston preferably is fitted with at least one piston ring seated in a circumferential piston ring groove to slide sealingly along the cylinder side wall. The cylinder preferably includes a cup-shaped cylinder bottom wall opposite the cylinder head with a central piston rod passing port for funneling blow-by oil to the piston rod so that the piston rod is lubricated by the oil and carries oil out of the cylinder with each cylinder and piston assembly cycle. The piston rod preferably includes at least one oil receiving depression for receiving and retaining oil to carry oil out of the cylinder through the piston rod passing port.

The rotational drive mechanism preferably includes an electric drive motor connected to the arm structure with a drive connection. The drive connection preferably includes a drive belt engaging a motor pulley mounted on the motor drive shaft and an arm structure pulley mounted on an arm structure axle.

The piston structure return mechanism preferably includes a piston rod biasing spring mounted to be compressed between a framework. The piston rod biasing spring preferably is a coil spring encircling the piston rod and optionally having a progressively narrowing, conical configuration, or a cylindrical configuration. The piston structure return mechanism preferably includes a piston return lever pivotally mounted on a lever fulcrum pin secured to the apparatus framework, having a return lever first end engaging the piston structure and a return lever second end positioned for periodic displacement by the at least one arm protrusion, with a solenoid coil preferably encircling the piston rod.

The arm protrusions may be fixed arms but preferably are selectively movable out of rotational alignment with the piston structure so that a desired number of the arm protrusions can be selected to displace the piston structure for each arm structure rotation; so that the volume of fluid compressed per arm structure rotation can be altered to accommodate requirements of any of a wide variety of applications. The where each arm includes an expanded mounting end which fits engagingly into any of several arm channels each having an outwardly narrowing arm engaging channel outward channel opening and extending laterally across the width of and spaced periodically around the arm wheel circumferential surface; so that each arm is slidably retained within a corresponding the arm channel. The arm wheel circumferential surface preferably is sufficiently wide and the arm channels therefore sufficiently long that one the arm can be slid to a first channel end of the given the arm channel and thus to a first side of the arm wheel circumferential surface to align with and abut the piston structure during arm wheel rotation, and slid to a second channel end and thus to a second side of the arm wheel circumferential surface to be out of registration with the piston structure during arm wheel rotation; so that a selected number of the arms can be slid to the first channel end to register with the piston structure as needed for a given apparatus application.

The arms preferably are each moved to one of the first side of the arm wheel circumferential surface and the second side of the arm wheel circumferential surface by electro magnets mounted adjacent opposing faces of the arm wheel and adjacent to the arm wheel circumferential surface; so that activation of either the electro magnet pulls each immediately adjacent arm to the adjacent the side of the arm wheel circumferential surface, and the given the electro magnet can be activated as the arm wheel is rotated by the drive mechanism so that only selected arms are moved to a given side of the arm wheel circumferential surface to provide a desired number of arms in registration with the at least one cylinder and piston assembly associated with the arm wheel.

The modular radial compressor optionally includes several of the cylinder and piston assemblies positioned to extend radially and equidistantly from the arm structure, so that the at least one arm protrusion abuts and displaces each piston structure in sequence with each the arm structure rotation.

More than one modular radial compressor can be installed over the same axle as shown in FIG. 10 and the clutch in each compressor will engage it to rotate with the axle or disengage it from the rotating axle as needed. The option of multiple modular radial compressors over the same axle is not conditioned upon the configurations of the individual modular radial compressors, and thus the modular radial compressors may have any desired numbers of arms or cylinders and still be installed over the same axle. The clutch of each compressor in the series individually engages or disengages the compressor from the common axle.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figures 1, 2:
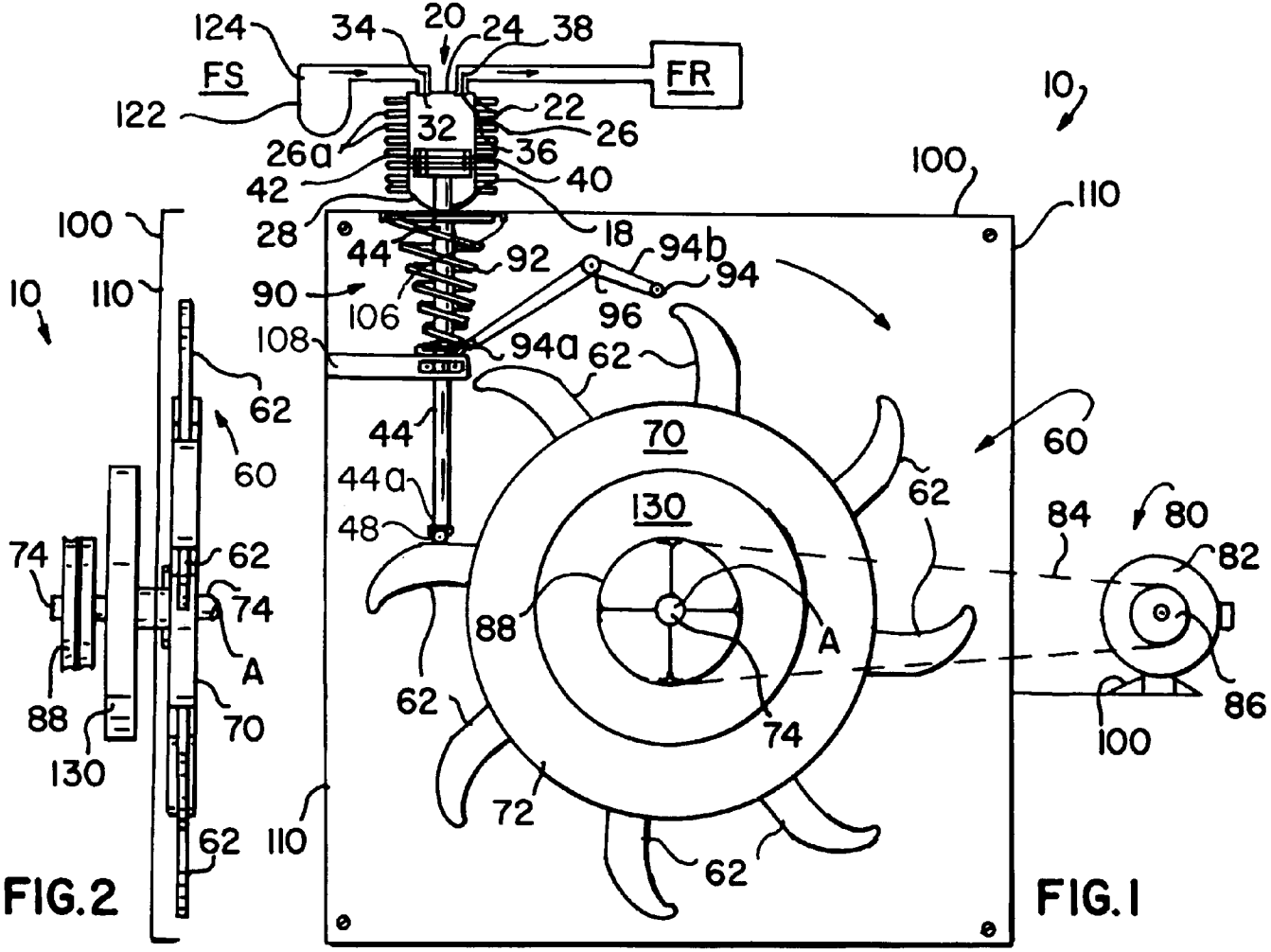
FIG. 1 is a side view of the a preferred embodiment of the modular radial compressor with the housing broken away to reveal the arm wheel, arm structures, and a cross-sectional view of the cylinder and piston assembly. The housing perimeter wall is shown in edge view, extending into the page. Piston return means shown in this FIGURE include the return spring and return lever.
FIG. 2 is an end view of the modular radial compressor of FIG. 1.
Figure 3:
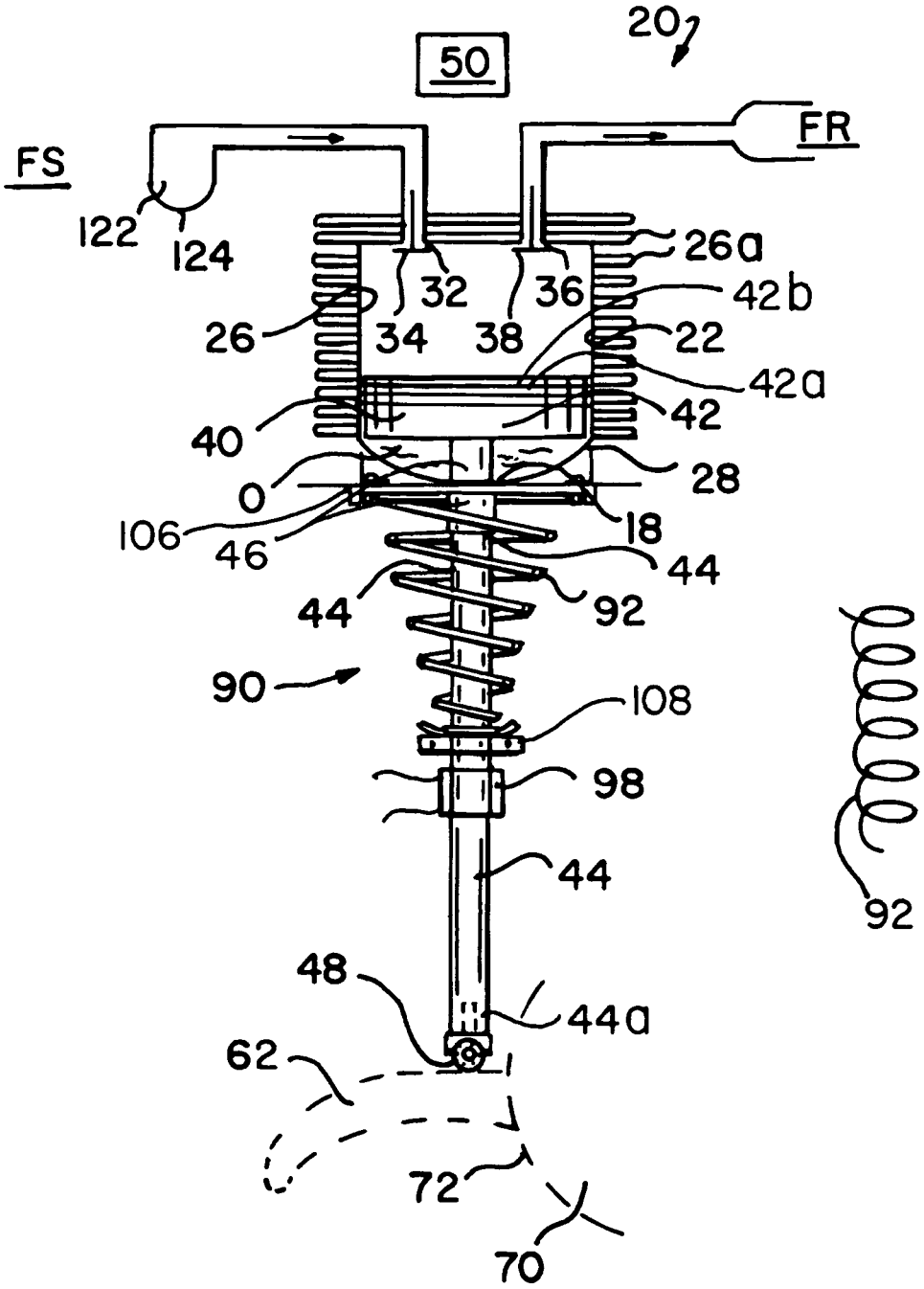
FIG. 3 is a close-up cross-sectional side view of the cylinder and piston assembly of FIG. 1. A cylindrical piston rod biasing spring is shown next to the cylinder and piston assembly to illustrate this alternative spring shape.
Figure 4:
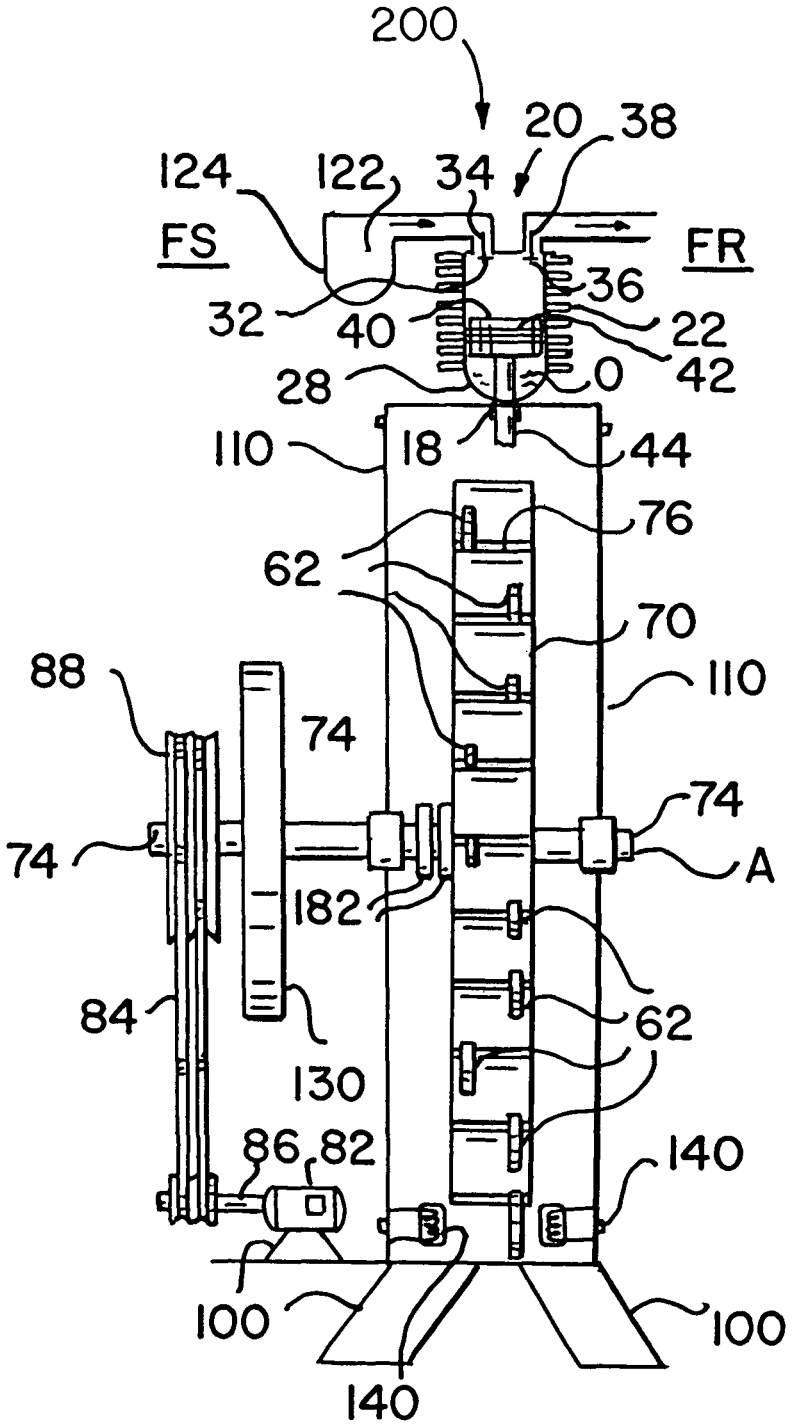
FIG. 4 is an end view of the apparatus of FIG. 1 but adding the preferred sliding arm structure feature and showing some of the arm structures slid to a first channel ends to register with the piston structure and other arm structures slid to second channel ends to be out of registration with the piston structure. Opposing electro-magnets for moving the arm structures to selected first or second channel ends are also shown.
Figure 5:
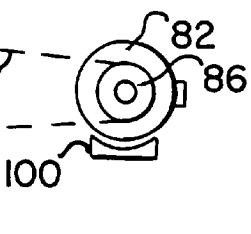
FIG. 5 is a side view of the arm wheel having the arm channels of FIG. 4.
Figure 6:
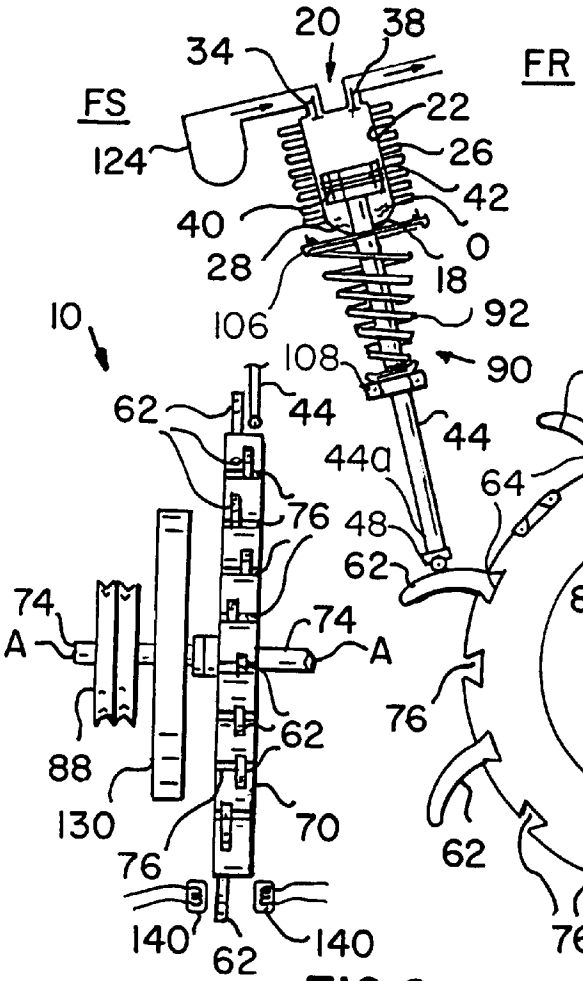
FIG. 6 is an end view of the modular radial compressor of FIG. 5.
Figure 7:
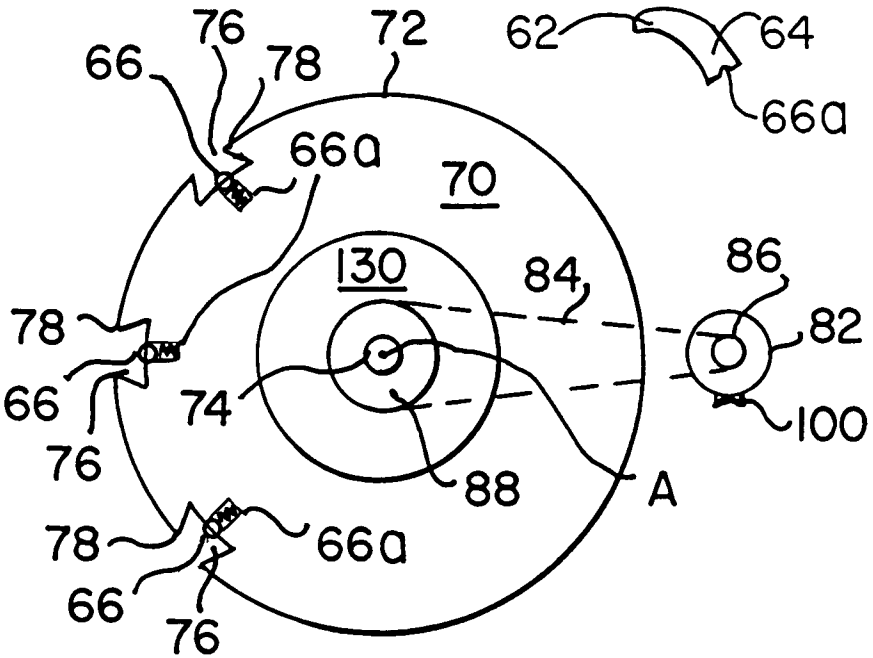
FIG. 7 is a side view of the arm wheel of FIG. 5 additionally showing the preferred spring-loaded retaining protrusions for retaining the arm structures at their selected first or second channel ends.
Figure 8:
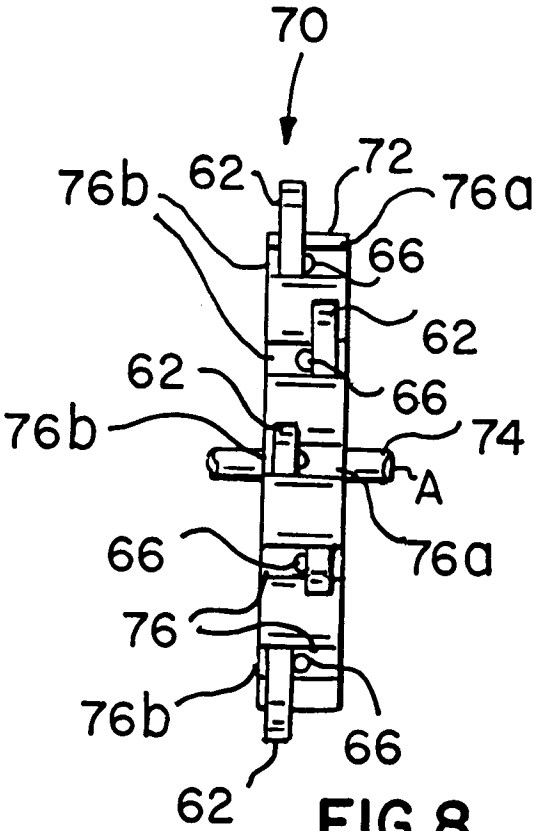
FIG. 8 is an end view of the arm wheel of FIG. 7, showing the preferred central position of the retaining protrusions in the arm channels.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-10, a modular radial compressor 10 is disclosed including at least one cylinder and piston assembly 20 having a cylinder 22 having a cylinder head 24 and a tubular cylinder side wall 26 and a piston structure 40 slidably retained within the cylinder side wall 26, the cylinder head 24 having an intake port 32 fitted with an intake valve 34 for passing fluid into the cylinder 22 from a fluid source FS and an output port 36 fitted with an output valve 38 for passing fluid out of the cylinder 22 such as to a fluid reservoir FR, valve operating means 50, a rotatable arm structure 60 having an arm structure rotational axis A and at least one radial arm protrusion 62 positioned to periodically abut and displace the piston structure 40 inwardly toward the cylinder head 24 and rotational drive means 80 drivably connected to the rotatable arm structure 60 for rotatably driving the arm structure 60 and the arm protrusion 62 about the arm structure rotational axis A, and a piston structure return means 90 for displacing the piston structure 40 outwardly away from the cylinder head 24 subsequent to each piston structure 40 inward displacement. As a result, such that the valve operating means 50 opens the output valve 38 and the arm protrusion 62 abuts and displaces the piston structure 40 toward the cylinder head 24, driving fluid within the cylinder 22 out of the cylinder 22 through the output port 36, and then the valve operating means 50 closes the output valve 38 and opens the intake valve 34 and the piston structure return means 90 displaces the piston structure 40 outwardly, away from the cylinder head 24 and the intake port 32, thereby drawing fluid through the intake port 32 into the cylinder 22 from the fluid source FS, in a periodically repeating cycle. Cylinder head 24 preferably is an integral part of the cylinder 22, although it is contemplated that it be made removable for servicing. Cylinder side wall 26 preferably is surrounded by heat fins 26*a* to increase outer surface area and thus increase the dissipation of heat from compressing a fluid. The cylinder and piston assembly 20 and arm structure 60 preferably are both fastened to an apparatus framework 100 to position them in operational relation with each other. The framework 100 may include an assembly 20 mounting perimeter wall, as shown in the various FIGURES. The apparatus framework 100 preferably includes an apparatus housing 110 which is optionally round or polygonal in perimeter shape, as shown in the various FIGURES, and alternatively may have any other desired shape. The intake port 32 optionally is covered by an air filter 122 retained within an air filter housing 124.

Modularity is a key inventive feature of the present invention. Either one or several single cylinder and piston assemblies 20 can be removably fastened to the framework, such as to the housing 110, with any suitable removable fastening means such as mounting bolts 112 passing through the housing 110 into or through the cylinder and piston assembly 20. Where mounting bolts 112 are used, bolt holes 114 are provided in the housing 110 for passing the mounting bolts 112 for each cylinder and piston assembly 20. These bolt holes 114 preferably are pre-cut during housing 110 manufacture, but alternatively may be cut any time thereafter. A piston shaft passing hole 116 may also be needed to mount a cylinder and piston assembly, as well as a supporting framework inner brace 108 extending from the housing 110. As a result, any desired number of cylinder and piston assemblies 20 up to the maximum number the particular housing 110 can accommodate can be mounted. Thus the number of cylinder and piston assemblies 20 needed for a specific use or application can be selected and provided on an individual modular radial compressor 10 of the present invention. The maximum efficiency is attained where eight cylinder and piston assemblies 20 are fastened to the housing 110.

The number of arm protrusions 62 provided on the arm structure 60 determines the number of compression cycles the cylinder and piston assembly 20 performs for each revolution of the arm structure 60, and is selected to meet the requirements of the given job or application. The arm structure 60 preferably includes an arm wheel 70 having an arm wheel circumferential surface 72 to which one or more arm protrusions 62 are mounted. The arm protrusions 62 preferably each include a radially extending arm mounted to the wheel circumferential surface 72. A flywheel 130 preferably is provided beside the arm wheel 70 and mounted to the arm wheel axle 74 to provide smooth arm structure 60 rotation.

The piston structure 40 preferably includes a piston 42 connected to a piston rod 44 extending out of the cylinder 22 opposite the cylinder head 24 and having a piston rod abutment end 44*a* fitted with a piston rod abutment end spring-loaded ball bearing 48 to ride over arm protrusions 62 with minimal friction and absorb the impact of abutting arm protrusions 62. The piston rod 44 preferably is fixedly secured to the piston 42 to remain substantially parallel to the cylinder side wall 26. The piston 42 preferably is fitted with conventional piston rings 42*a* seated in circumferential piston ring grooves 42*b* to slide sealingly along the cylinder side wall 26. The cylinder 22 preferably has a cylinder bottom wall 28 opposite the cylinder head 24 with a central piston rod passing port 18. Oil O lubricates the cylinder side wall 26 and is retained by the cylinder bottom wall 28, which preferably is cup-shaped to gather the oil O and funnel it toward the piston rod 44. Oil O thus deposited on the piston rod 44 enters and is retained by a longitudinal series of oil gathering depressions 46 in the piston rod 44, preferably in the form of a series of notches 46, and thus is carried by the piston rod 44 out of the cylinder 22. This mechanism removes blow-by oil O accumulated in the cylinder 22 and at the same time lubricates the piston rod 44 so that it moves through the port 18 in the cylinder bottom wall 28 with minimal friction.

The rotational drive means 80 preferably includes an electric drive motor 82 connected to the arm structure 60 with a drive connection. The drive connection extends between the drive motor 82 and the arm structure 60 and preferably takes the form of a drive belt 84 engaging a motor pulley 86 mounted on the motor drive shaft 82*a* and an arm structure pulley 88 mounted on an arm structure axle 74. The arm structure axle 74 preferably is mounted in bearings retained in axle retaining members 102 and 104 which form part of the apparatus framework 100.

The piston structure return means 90 preferably is a piston rod biasing spring 92 mounted to be compressed between a framework outer brace 106 and a framework inner brace 108 and engaged by a return spring pin (not shown) passing through the piston rod 44. The piston rod biasing spring 92 preferably is a coil spring encircling the piston rod 44 and preferably has a progressively narrowing, conical configuration, or a cylindrical configuration. Alternatively or additionally the piston structure return means 90 is a piston return lever 94 rotatably mounted on a lever fulcrum pin 96 secured to the apparatus framework 100. See FIG. 1. A return lever first end 94*a* engages the piston structure 40 such as the piston rod 44 and a return lever second end 94*b* is periodically displaced by the arm protrusion 62 or arm protrusions 62. Another alternative or additional piston return means 90 is a piston return solenoid coil 98 fitted around the piston rod 44 wired to a power source through a switch. When activated, piston return solenoid coil 98 rapidly drives the piston rod 44 and piston 42 away from the cylinder head 24.

The number of arm protrusions 62 on the arm structure 60 preferably can be altered such that the volume of fluid compressed per arm structure 60 revolution can be altered to accommodate any of a wide variety of applications. Where the arm protrusions 62 are arms 62, each arm 62 preferably has an expanded arm mounting end 64 which fits engagingly into any of several arm channels 76 having outwardly narrowing arm engaging channel outward ends 78 and extending laterally across the width of and spaced periodically around the arm wheel circumferential surface 72 such that each arm 62 is slidably retained within a corresponding arm channel 76. See FIGS. 4-6. The wheel circumferential surface 72 preferably is sufficiently wide and the arm channels 76 therefore sufficiently long that an arm 62 can be slid to a first channel end 76*a* of the given arm channel 76 and thus to a first side of the arm wheel circumferential surface 72 to align and register with and abut the piston structure 40, and slid to a second channel end 76*b* and thus to a second side of the arm wheel circumferential surface 72 to be out of registration with the piston structure 40 during arm structure 60 rotation. The arms 62 are retained against sliding out of their respective channels 76 by a retaining clip 77 at the outward-most portion of each channel end 76*a* and 76*b*. See FIG. 5. As a result, a selected number of arms 62 can be slid into position to register with the piston structure 40 as needed for each given apparatus 10 application. The modular radial compressor 10 can start with zero compression and gradually the arms 62 can be moved to the aligned position for compression and out of alignment again, if there is no demand for compressed gas such as air. This arm sliding can be done electrically, by any suitable electric mechanism, and operated remotely such as through a computer.

An outwardly biased spring-loaded retaining protrusion 66 is provided in the a recess in the middle of each arm channel end 76*a* and 76*b* to obstruct movement of and thus retain the arm 62 in the channel 76 at either the first or second channel end 76*a* or 76*b*, respectively. See FIGS. 7 and 8. The retaining protrusions 66 are outwardly rounded, and when sufficient lateral force is applied to a given arm 62, such as be an electro-magnet 140 described below, the retaining protrusion 66 is forced inwardly into its protrusion recess 66*a* by the arm 62 to become flush with the channel 76 bottom wall, permitting the arm 62 to move over the retaining protrusion 66 to the opposing channel end, and then the protrusion 66 is freed to spring outwardly to its initial retaining position.

The arms 62 preferably are moved to first or second arm wheel 70 sides by electro magnets 140 mounted to the apparatus framework 100 on opposing sides of the arm wheel 70 adjacent the arm wheel 70 circumferential perimeter. A small air gap is provided between the arms 62 and the electro magnets 140 so that arms 62 and electro magnets 140 never touch each other. Activation of either electro magnet 140 pulls each immediately adjacent arm 62 to the adjacent side of the arm wheel 70. The given electro magnet 140 are activated for only a fraction of a second as the arm wheel 70 is rotated by the drive motor 82 so that only selected arms 62 are moved to a given side of the arm wheel 70 to provide a desired number of arms 62 in registration with the at least one cylinder and piston assembly 20 associated with the given arm wheel 70. Electric power delivered through a manual switch or a computer programmed controller (not shown) activates one or the other electro magnet 140 as needed. Many other arm protrusion 62 moving mechanisms are contemplated, and the electro magnets are merely illustrative.

Another variation of the present modular radial compressor 10 includes a plurality of cylinder and piston assemblies 20 positioned and secured to the apparatus framework 100 to extend radially and equidistantly from the arm structure 60. See FIGS. 9 and 9A. The rotating arm protrusion 62 or arm protrusions 62 abut and displace each piston structure 40 in sequence with each arm structure 60 rotation.

Figure 9:
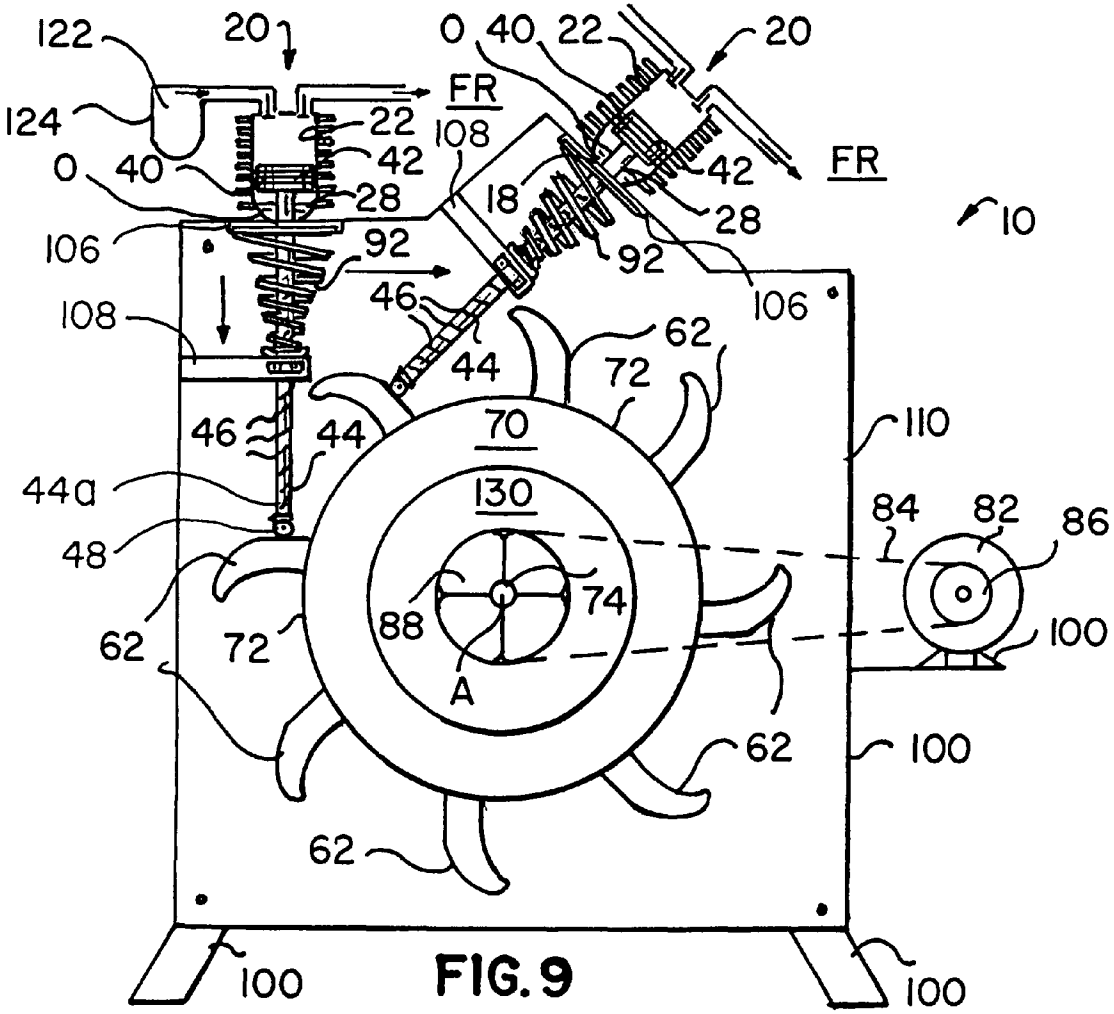
FIG. 9 is a view as in FIG. 1, except that the modularity of the present invention is fully illustrated with the mounting of a second cylinder and piston assembly in a second mounting opening in the housing, thus exercising the option of providing two or more such assemblies on a given apparatus arm structure and cylinder unit. The housing can have a round, polygon or any other perimeter shape.

FIG. 9 is a view as in FIG. 1, except that the modularity of the present invention is fully illustrated with the mounting of a second cylinder and piston assembly 20 in a second mounting opening in the housing 110, thus exercising the option of providing two or more such assemblies 20 on a given modular radial compressor. The housing 110 can have a round, polygon or any other perimeter shape. As can be deduced from this FIGURE, if eight cylinder and piston assemblies 20 are included in this way, numerically matching the eight arm protrusions 62 on the arm wheel 74, the modular radial compressor 10 can produce 64 compressions with each revolution of the wheel axle 74.

Figure 9A:
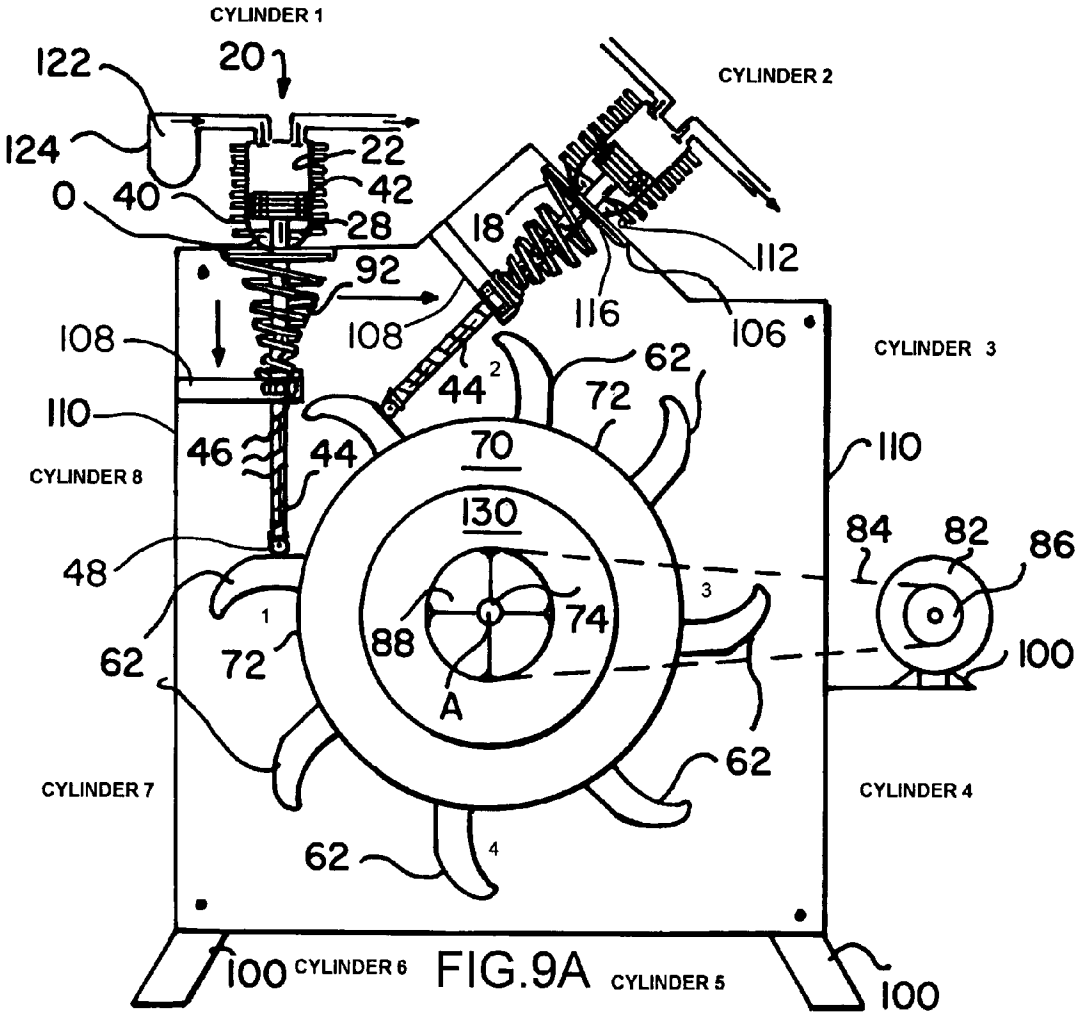
FIG. 9A is a view as in FIG. 9, except that four rather than eight arm structures are provided. The locations and potential locations of eight cylinder and piston assemblies are labeled as CYLINDERS 1-8.
Figure 9B:
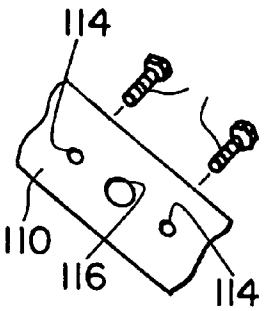
FIG. 9B is a broken away perspective view of a portion of the housing wall showing an exemplary bolt hole and piston shaft passing hole and mounting bolt for mounting one of the single cylinder and piston assemblies.
Figure 10:
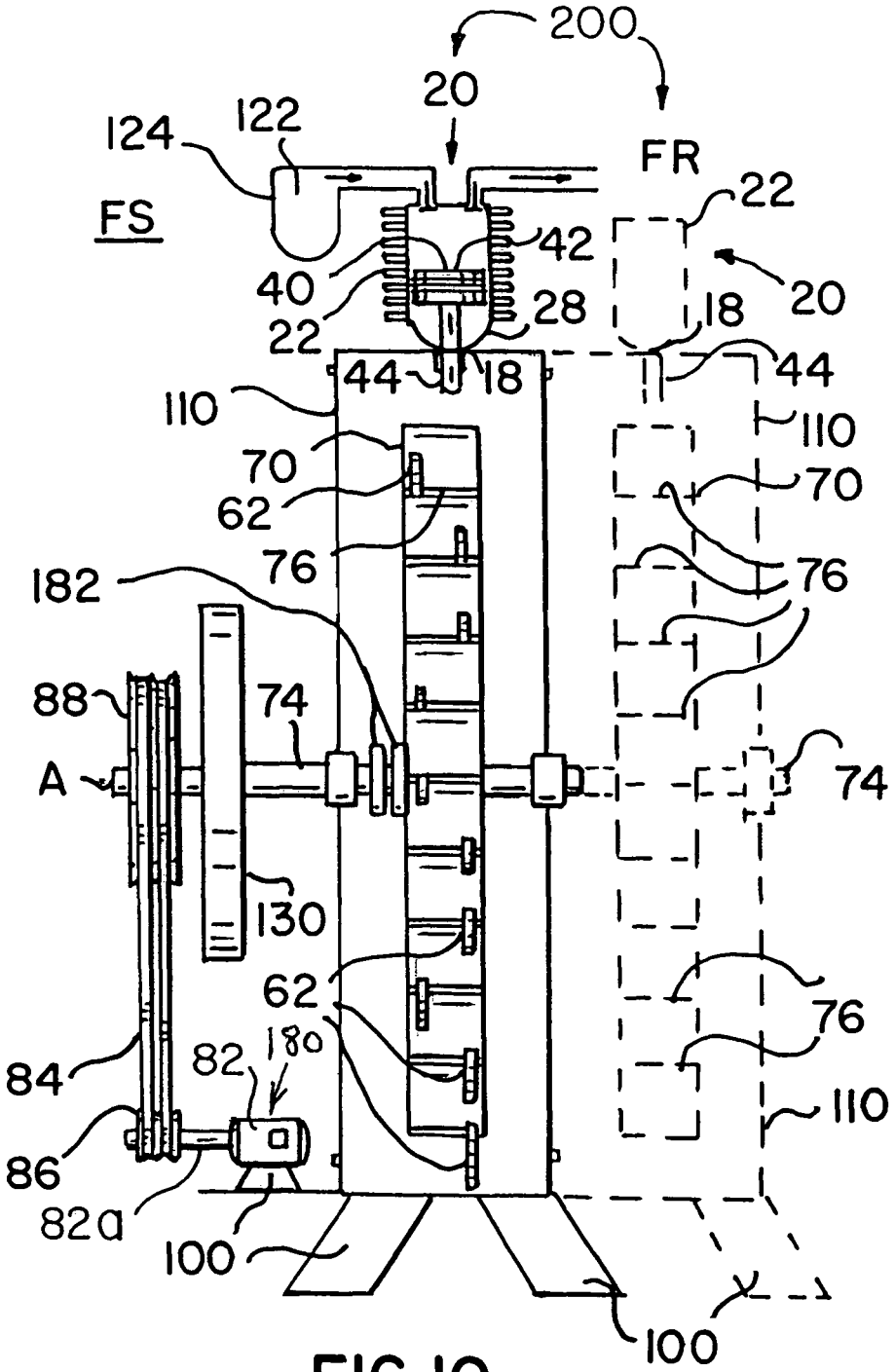
FIG. 10 is an end view of the apparatus of FIG. 4, showing an optional second arm structure and cylinder unit, to illustrate the option of providing two or more such units in an individual modular radial compressor.

FIG. 9A is a view as in FIG. 9, except that four rather than eight arm structures 62 are provided. As noted in the Description of Drawings, the locations and potential locations of eight cylinder and piston assemblies 20 are labeled as CYLINDERS 1-8. Since the present compressor 10 is modular, a cylinder and piston assembly 20 can be removed from the housing 110 so that only one assembly 20 remains, and one or more cylinder and piston assemblies 20 can be added to increase compressed fluid capacity by fastening them to the housing 110 at equal radial distances from the motor drive structure axle, as may be needed for particular uses. Where eight cylinder and piston assemblies 20 are attached to this four arm compressor, 32 compressions are produced with each revolution of the wheel axle 74. Of course the same modularity is provided for the compressor 10 of FIG. 9, or for such compressors 10 have any other number of arm structures 62.

Yet another variation of the compression apparatus 10 includes multiple arm structure and cylinder units 200. The arm structures 60 preferably are arm wheels 70 mounted on a common axle and thus driven by a common rotation drive means 180 in the form of a motor. See FIG. 10. Individual clutch means 182 are provided for each arm structure 60 so that only a selected number of the arm structures 60 rotate with the drive means 180.

As an alternative to the one or more cylinder and piston structure assemblies 20, a bellows or other collapsible vessel (not shown) may be provided.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A modular radial compressor for compressing fluids, comprising:

a cylinder and piston assembly comprising a cylinder having a cylinder head and a tubular cylinder side wall and a piston structure slidably retained within said cylinder and constrained by said cylinder to move along a piston structure central axis of reciprocation, said cylinder having an intake port fitted with an intake valve for passing fluid into said cylinder from a fluid source and an output port fitted with an output valve for passing fluid out of said cylinder;

a rotatable arm structure for one of a single arm and multiple arms having an arm structure rotational axis and an arm wheel with an arm wheel minimum radius outward from said arm structure rotational axis and at least one radial arm protrusion extending radially outward from said arm wheel and positioned to periodically abut and displace through movement of said at least one arm protrusion said piston structure inwardly toward said cylinder head;

rotational drive means drivably connected to said rotatable arm structure for rotatably driving said arm structure and said arm protrusion along a circular path about said arm structure rotational axis, said arm structure being positioned relative to said cylinder and piston assembly such that said piston structure central axis of reciprocation is spaced radially from said arm structure rotational axis a distance greater than said arm wheel minimum radius;

a return means for the piston structure for displacing said piston structure outwardly and away from said cylinder head subsequent to each piston structure inward displacement;

support structure means comprising a housing having a housing wall to which said cylinder and piston assembly is mounted;

at least a second cylinder and piston assembly having a second intake valve and a second output valve;

said support structure means comprising assembly mounting means for removably mounting said second cylinder and piston assembly to said housing wall.

2. The modular radial compressor of claim 1, wherein said support structure means comprises an apparatus framework to position said assemblies and said arm structure in operational relation with each other.

3. The modular radial compressor of claim 1, wherein said assembly mounting means comprises registering fastener passing holes in said cylinder and piston assembly and in said housing wall, and a fastener for passing through said registering fastener passing holes.

4. The modular radial compressor of claim 3, wherein said fastener passing holes are bolt holes and said fastener is a bolt.

5. The modular radial compressor of claim 1, wherein said at least one arm protrusion is at least one arm and wherein said arm wheel is substantially circular and has an arm wheel circumferential surface to which said at least one arm is mounted.

6. The modular radial compressor of claim 1, additionally comprising a flywheel mounted to rotate in unison with said arm structure to provide smooth arm structure rotation.

7. The modular radial compressor of claim 1, wherein said piston structure comprises a piston connected to a piston rod extending out of said cylinder opposite said cylinder head having a piston rod abutment end.

8. The modular radial compressor of claim 1, wherein said piston is fitted with at least one piston ring seated in a circumferential piston ring groove to slide sealingly along said cylinder side wall.

9. The modular radial compressor of claim 7, wherein said cylinder comprises a cup-shaped cylinder bottom wall opposite said cylinder head with a central piston rod passing port for funneling blow-by oil to said piston rod such that said piston rod is lubricated by the oil and carries oil out of the cylinder with each cylinder and piston assembly cycle.

10. The modular radial compressor of claim 9, wherein said piston rod comprises at least one oil receiving depression for receiving and retaining oil to carry oil out of said cylinder through said piston rod passing port.

11. The modular radial compressor of claim 1, wherein said rotational drive means comprises an electric drive motor connected to said arm structure with a drive connection.

12. The modular radial compressor of claim 11, wherein said drive connection comprises a drive belt engaging a motor pulley mounted on a motor drive shaft and an arm structure pulley mounted on an arm structure axle.

13. The modular radial compressor of claim 2, wherein the return means for said piston structure comprises a piston rod biasing spring mounted to be compressed between a framework and said piston structure.

14. The modular radial compressor of claim 13, wherein said piston rod biasing spring is a coil spring encircling said piston rod and having a progressively narrowing, conical configuration.

15. The modular radial compressor of claim 1, wherein said arm protrusions are selectively movable out of rotational alignment with said piston structure such that a desired number of said arm protrusions can be selected to displace said piston structure for each arm structure rotation;

such that the volume of fluid compressed per arm structure rotation can be altered.

16. The modular radial compressor of claim 5, wherein each said arm comprises an expanded mounting end which fits engagingly into any of a plurality of arm channels, each arm channel having a channel opening of a certain width and widening with channel depth to correspond generally with the configuration of and thereby engagingly receive the expanded mounting ends of the arms and extending laterally across the width of and spaced periodically around said arm wheel circumferential surface;

such that each arm is slidably retained within a corresponding said arm channel.

17. The modular radial compressor of claim 1, wherein said at least one arm protrusion is at least one arm and wherein said rotatable arm structure comprises an arm wheel having an arm wheel circumferential surface to which said at least one arm is mounted; wherein each said arm comprises an arm mounting end which fits engagingly into any of a plurality of arm channels, each having a channel opening with arm engaging means, said plurality of arm channels extending in a lateral series spaced periodically across the width of said arm wheel circumferential surface, such that each arm is slidably retained within a corresponding said arm channel;

wherein said arm wheel circumferential surface is sufficiently wide and said arm channels therefore sufficiently long that one said arm can be slid to a first channel end of one of said arm channels and thus to a first side of said arm wheel circumferential surface to align with and abut said piston structure during rotation of the arm wheel, and slid to a second channel end and thus to a second side of said arm wheel circumferential surface to be out of registration with said piston structure during rotation of the arm wheel;

such that one or more of said at least one arm can be slid to said first channel end to register with said piston structure as needed for a given modular radial compressor application.

18. The modular radial compressor of claim 17, wherein said at least one arm is each configured to be moved to one of said first side of said arm wheel circumferential surface and said second side of said arm wheel circumferential surface by electro magnets mounted adjacent opposing faces of said arm wheel and adjacent to the arm wheel circumferential surface;

such that activation of either said electro magnet pulls each immediately adjacent arm to the adjacent said side of said arm wheel circumferential surface, and the electromagnets can be activated as said arm wheel is rotated by said drive means such that only selected said at least one arm is moved to a given side of said arm wheel circumferential surface to provide a desired number of said at least one arm in registration with said at least one cylinder and piston assembly associated with said arm wheel.

19. The modular radial compressor of claim 1, comprising a plurality of said cylinder and piston assemblies positioned to extend radially and equidistantly from said arm structure, such that said at least one arm protrusion abuts and displaces each said piston structure in sequence with each said arm structure rotation.

20. The modular radial compressor of claim 1, additionally comprising:

a plurality of said arm structure and cylinder units mounted on a common axle and each comprising a cylinder and piston assembly, and each cylinder and piston assembly comprising a cylinder having a cylinder head and a tubular cylinder side wall and a piston structure slidably retained within said cylinder and constrained by said cylinder to move along an axis of reciprocation, said cylinder having an intake port fitted with an intake valve for passing fluid into said cylinder from a fluid source and an output port fitted with an output valve for passing fluid out of said cylinder;

a plurality of said rotatable arm structures each having an arm structure rotational axis and at least one radial arm protrusion positioned to periodically abut and displace a plurality of said piston structures inwardly toward said cylinder heads of said arm structure and cylinder units, and individual clutch means for each said arm structure said rotational drive means comprising said common axle and wherein said return means for said piston structure for each said piston structure displaces a corresponding said piston structure outwardly and away from a corresponding said cylinder head subsequent to each piston structure inward displacement.

21. A modular radial compressor, comprising:

at least one cylinder and piston assembly comprising a cylinder having a cylinder head and a tubular cylinder side wall and a piston structure slidably retained within said cylinder and constrained by said cylinder to move along a piston structure central axis of reciprocation said cylinder having an intake port fitted with an intake valve for passing fluid into said cylinder from a fluid source and an output port fitted with an output valve for passing fluid out of said cylinder;

a rotatable arm structure having an arm structure rotational axis and an arm wheel with an arm wheel minimum radius outward from said arm structure rotational axis and at least one radial arm protrusion having a longitudinal aim protrusion curved guide surface and extending radially outward from said arm wheel and positioned such that at least a portion of said curved longitudinal arm protrusion guide surface periodically transmits force to and thereby displaces said piston structure inwardly toward said cylinder head;

rotational drive means drivably connected to said rotatable arm structure for rotatably driving said arm structure and said arm protrusion along a circular path about said arm structure rotational axis, said arm structure being positioned relative to said cylinder and piston assembly such that said piston structure central axis of reciprocation is spaced radially from said arm structure rotational axis a distance greater than said arm wheel minimum radius;

and a return means for said piston structure for displacing said piston structure outwardly and away from said cylinder head subsequent to each piston structure inward displacement;

and wherein each said cylinder and piston assembly and said rotatable arm structure are fastened to an apparatus framework to position each said cylinder and piston assembly in operational relation with said rotatable arm structure.

* * * * *